US005097894A

United States Patent [19]

Cassia

[11] Patent Number: 5,097,894

[45] Date of Patent: Mar. 24, 1992

[54] VEHICULAR FLUSHING AND DRAINING APPARATUS AND METHOD

[76] Inventor: Roland Cassia, 12 Allan Dr., White Plains, N.Y. 10605

[21] Appl. No.: 726,382

[22] Filed: Jul. 5, 1991

[51] Int. Cl.[5] ..... F28G 9/00

[52] U.S. Cl. ..... 165/71; 165/95; 123/41.14; 134/169 A

[58] Field of Search ..... 165/95, 71; 123/41.14; 134/169 A

[56] References Cited

U.S. PATENT DOCUMENTS 3,653,430 4/1972 Kinast ..... 165/71

4,763,724 8/1988 Temmesfeld et al. ..... 165/71

4,793,403 12/1988 Vataru et al. ..... 165/95

4,911,211 3/1990 Andersen ..... 123/41.14

*Primary Examiner*—Albert W. Davis, Jr.

*Attorney, Agent, or Firm*—Lucas & Just

[57] ABSTRACT

The apparatus and method for flushing and draining the radiator and cooling system of a vehicle employs a drain pipe which allows for draining of the radiator and flushing of the cooling system. A drain pipe which connects to the bottom of the radiator has a bend of 180° near the top of the radiator but below the fluid level of the radiator. The outlet of the drain pipe is below the inlet for the drain pipe.

8 Claims, 5 Drawing Sheets

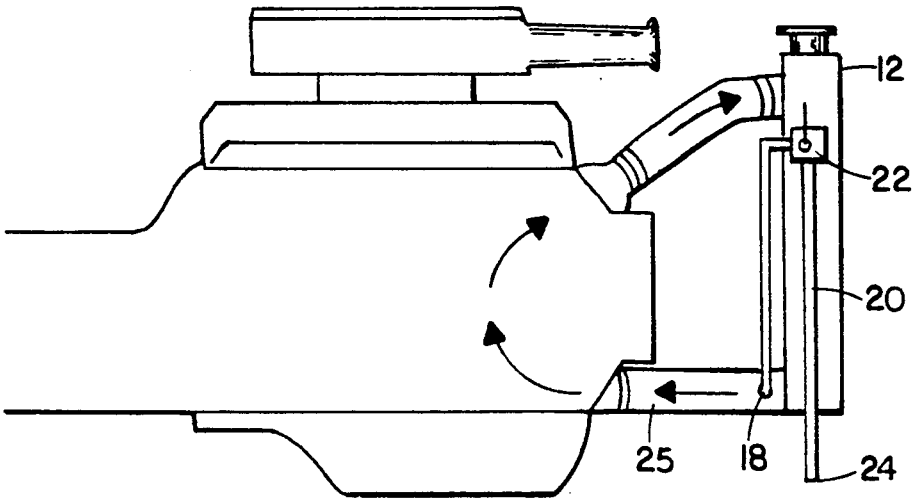
FIG. 3.
FIG. 4.
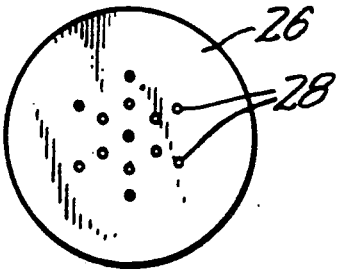
FIG. 5.
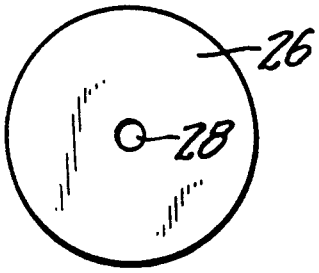

VEHICULAR FLUSHING AND DRAINING APPARATUS AND METHOD

This invention relates to an apparatus and method for flushing and draining a cooling system or a motor and specifically the cooling system of an internal combustion engine of a vehicle.

Corrosion materials such as rust and solder corrosion residue are formed in the cooling systems of vehicles as the corrosion inhibitors in antifreeze break down from heat over time. These corrosion materials reduce cooling system efficiency. Additionally, the abrasive nature of the suspended corrosive materials increases the wear on the radiator, water pump, hoses, thermostat, and heater core. Malfunction of cooling system components is one of the most common causes of vehicle breakdowns on the highway.

Most vehicle manufacturers recommend changing the coolant every year. To properly change the coolant in a vehicle's cooling system, it is necessary to flush and drain the radiator, the engine block, the heater core and the connecting hoses. Flushing and draining of only the radiator does not flush or drain the coolant from the engine block, heater and the connecting hoses because the flow of coolant from the latter areas to the radiator is blocked by a thermostatically regulated valve which is closed unless the system is at operating temperature. Conventionally, this valve is simply called the thermostat.

There are presently several different approaches an individual vehicle owner or a mechanic can follow to flush and drain old coolant from the entire cooling system. All have their drawbacks.

Because of the limitations of the known methods for draining and flushing the cooling system of their vehicle, many car owners do not replace used coolant. Therefore, a large number of vehicles are not serviced as they should be, leading to high costs of poorer performance and more frequent maintenance, shortened engine life, and more frequent highway break downs. Such costs could be reduced by providing a simplified way to properly flush the cooling system and recharge it with fresh coolant, without the need for substantial mechanical expertise and physical labor.

The present invention is an improved radiator for use in a vehicle or other machinery which has an engine with a cooling system. Specifically, the present invention is used in a radiator having a core for cooling the circulating fluid. The core is enclosed in a shell and the shell has an inlet and outlet for the circulating fluid to allow the circulating fluid to circulate throughout the cooling system, i.e. engine block, heater, etc. The present invention comprises a drain pipe having an inlet in fluid communication with the circulating fluid, said inlet being positioned at the bottom of the shell of the radiator and said drain pipe having an outlet which is positioned at a point below the inlet of the drain pipe, said drain pipe providing a fluid channel for fluid in said cooling system to leave said cooling system, said drain pipe having a bend of about 180° therein, said bend being located below the fluid level or intended fluid level in the radiator but above both the inlet and outlet of said drain pipe; a flushing fluid inlet connected to the shell for introduction of flushing fluid into the cooling system to allow for flushing of the system; and valve means to open and close the fluid channel in said drain pipe. In order to drain fluid from said radiator shell when said valve means is open, air is allowed to enter the radiator. The cooling fluids leave the cooling system through the drain pipe during the flushing operation.

The present invention can be used for both cross-flow radiators, down-flow radiators, and closed radiator systems.

In a cross-flow radiator, the flushing fluid inlet is positioned on the opposite side of the radiator shell from the drain pipe. In a down-flow radiator, the flushing fluid inlet can be on either side of the radiatory shell.

Preferably, a flushing fluid inlet pipe is connected to the flushing fluid inlet and positioned in said radiator shell so as to distribute flushing fluid from said flushing fluid inlet across the radiator core. Preferably, the flushing fluid inlet pipe is perforated to distribute flushing fluid uniformly throughout the core.

It is also preferred that the valve means be positioned in said drain pipe at the bend in said drain pipe so as to provide easy access to open and close the valve means. The bend in the drain pipe is preferably located at the top of the radiator shell but below the fluid level in the radiator shell.

In order to drain the radiator, the valve means is opened and either the flushing fluid inlet or the radiator cap (alternatively just the vent lever of the radiator cap) is opened to allow air to get into the shell. Because the outlet of the drain pipe is positioned below the inlet to the drain pipe and because the bend in the drain pipe is located below the fluid level in the radiator, the cooling fluid in the radiator will flow out of the radiator once the valve means is in the open position. The bend in the drain pipe must be below the fluid level in the radiator so that when the valve is open there is enough pressure to force coolant fluid out the drain pipe. In a closed radiator system air is introduced to the system during the draining process by means of the overflow cap on the vent lever on the overflow cap. This overflow cap is sometimes referred to as the radiator cap. Alternatively, the flushing fluid inlet can be opened.

In order to flush the radiator, the valve means is opened and flushing fluid is introduced through the flushing fluid inlet means. The flushing fluid will pass through the core of the radiator and out of the radiator through the drain pipe. The radiator cap and the vent lever should be closed during flushing.

In order to flush the cooling system, the engine must be running and up to temperature in order to open all internal valves in the cooling system and to circulate the cooling fluid through the cooling system. Then flushing fluid is circulated into the system through the flushing fluid inlet and the valve means is opened to allow the flushing fluid and old coolant to leave the system.

As will be evident from the below discussion of the present invention, pre-existing radiators can be modified to conform to the present invention. The drain pipe can be positioned either inside the shell; outside the shell; or one half inside the shell while the other half is positioned outside the shell. The inlet of the drain pipe must be positioned at the bottom of the radiator so as to pick up the flushing fluid after it has passed through the core. Preferably, the inlet to the drain pipe is positioned about 0.5 to 2 inches from the bottom of the radiator shell. The outlet end of the drain pipe must be positioned below the inlet end of the drain pipe. Preferably, the bend in the drain pipe is located between 1 inches and 2 inches below the fluid level or intended fluid level in the radiator. The drain pipe employs a single 180° bend.

These and other aspects of the present invention may be more fully understood by reference to the following drawings wherein:

FIG. 3 illustrates a portion of a radiator which has been modified in accordance with the present invention wherein the drain pipe is connected to the exit pipe of the radiator;

FIG. 4 illustrates a disk which is used in the flushing fluid inlet in order to increase the fluid pressure of the flushing fluid;

FIG. 5 illustrates another embodiment of the disk used in the flushing fluid inlet;

Figure 1:
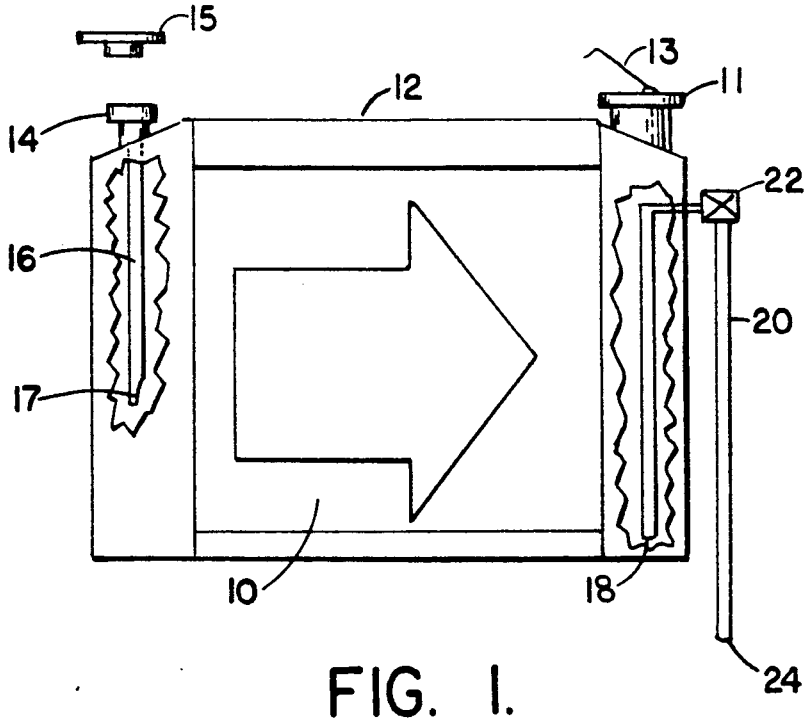
FIG. 1 illustrates a cross-flow radiator modified in accordance with the present invention.

FIG. 1 illustrates a cross-flow radiator made up of core 10 which is surrounded by shell 12. Cap 11 with vent lever 13 is for radiator shell 12. In shell 12 at the upper lefthand corner is positioned flushing fluid inlet 14. Cap 15 is for flushing fluid inlet 14. Connected to flushing fluid inlet 14 is flushing fluid inlet pipe 16 which is restricted at end 17. Flushing fluid inlet 14 and pipe 16 allows flushing fluid to be introduced into the radiator shell through flushing fluid inlet 14 and out through pipe 16. The flushing fluid then passes through core 10 as illustrated by the arrow in FIG. 1. When flushing fluid leaves core 10, it travels down by the force of gravity to inlet 18 of drain pipe 20. The flushing fluid then passes through valve 22. After leaving valve 22, the flushing fluid passes down through drain pipe 20 and outlet 24. As illustrated in FIG. 1, outlet 24 of drain pipe 20 is below inlet 18 of drain pipe 20. In a cross-flow radiator, it is important that the flushing fluid inlet is on the opposite side of the radiator from the drain pipe inlet.

Figure 2:
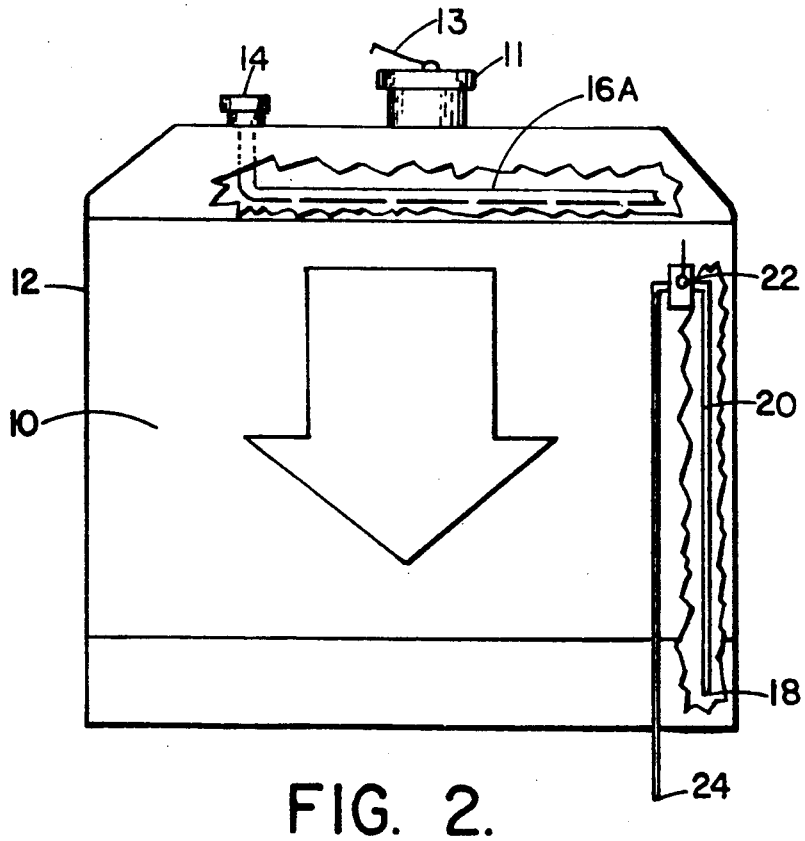
FIG. 2 illustrates a down-flow radiator modified in accordance with the present invention.

FIG. 2 illustrates a radiator modified in accordance with the present invention for a down-flow radiator. In the case of the down-flow radiator as illustrated in FIG. 2, radiator core 10 is surrounded by radiator shell 12. Flushing fluid is introduced through flushing fluid inlet 14 and passes through perforated pipe 16A to introduce flushing fluid across the core. The flushing fluid then passes through the core as illustrated by the arrow in FIG. 2. The flushing fluid once passing through core 10 passes to inlet 18 of drain pipe 20. Flushing fluid then passes up through drain pipe 20 and into valve 22. The flushing fluid after passing through valve 22 then passes down through drain pipe 20 and out through outlet 24 of drain pipe 20. As is illustrated in FIG. 2, outlet 24 of drain pipe 20 is below inlet 18 to drain pipe 20. In a down-flow radiator the drain pipe can be connected on either side of the radiator.

FIG. 3 illustrates an alternative embodiment to the present invention wherein drain pipe 20 is positioned on the outside of radiator shell 12 and inlet 18 of drain pipe 20 is connected to the bottom of the radiator shell by means of radiator exit pipe 25. Specifically, radiator shell 12 has a cooling fluid outlet positioned at the bottom corner of shell 12. Radiator shell cooling fluid outlet is connected to radiator exit pipe 25. Radiator exit pipe 25 provides cooling fluid to the engine block. Drain pipe 20 is positioned along the side of shell 12 and is connected at inlet end 18 to radiator exit pipe 25. Outlet 24 of drain pipe 20 is below inlet 18 of drain pipe 20.

As can be seen in FIGS. 1–3, valve 22 is located in the 180° bend in drain pipe 20 and the bend is located below the normal fluid level in radiator shell 12. The bend in drain pipe 20 as depicted in FIGS. 6–8 and 12 is located below the fluid level in radiator shell 12.

In one application of the present invention, the radiator of the vehicle is flushed by merely opening the valve 22 which, due to the fact that the fluid normally contained within the radiator is under pressure, causes the fluid in the radiator to flow out of the radiator by means of the drain pipe. Valve means 22 can also be a small electric pump for withdrawing fluid from the vehicle's cooling system. The pump can be run off of the vehicle's electrical system or an external electrical system.

Preferably, inlet 14 has a disk 26 therein as shown in FIGS. 4 and 5. Disk 26 is adapted so that flushing fluid is passed under pressure into the radiator through inlet 14. Disk 26 is adapted to decrease the surface area of flow of the flushing fluid and therefore increase the rate of flow. Suitable adaptations to disk 26 include a decrease in size of the aperture for transmission of flushing fluid therethrough, or use of a plurality of smaller apertures instead of one larger aperture. Different variations of the apertures of disk 26 are shown in FIGS. 4 and 5. FIG. 5 shows disk 26 having aperture 28 which is smaller in surface area than the end of the garden hose. FIG. 4 shows disk 26 having a plurality of smaller apertures 28, the total surface area of apertures 28 being less than the surface area of the end of the garden hose. It is preferred that the total surface area of apertures 28 be less than about 75% of the surface area of disk 26. It is more preferred that the surface area of apertures 28 be less than about 60% of the surface area of disk 26, and it is most preferred that the surface area of apertures 28 be less than about 50% of the surface area of disk 26. Good results have been found where the apertures measure about 1/6 inch to about 3/16 inch in diameter. It will be evident to one of skill in the art that both the temperature and volume of flushing fluid that enters the radiator must be such that the temperature of the fluid in the cooling system must be hot enough to maintain the thermostat in an open position during flushing.

The flushing fluid can be a conventional flushing fluid used for vehicle cooling systems to include water from a garden hose. Either the flushing fluid inlet or the radiator shell inlet covered by cap 11 can be used to add new cooling fluid once flushing and/or draining is complete.

Figure 6:
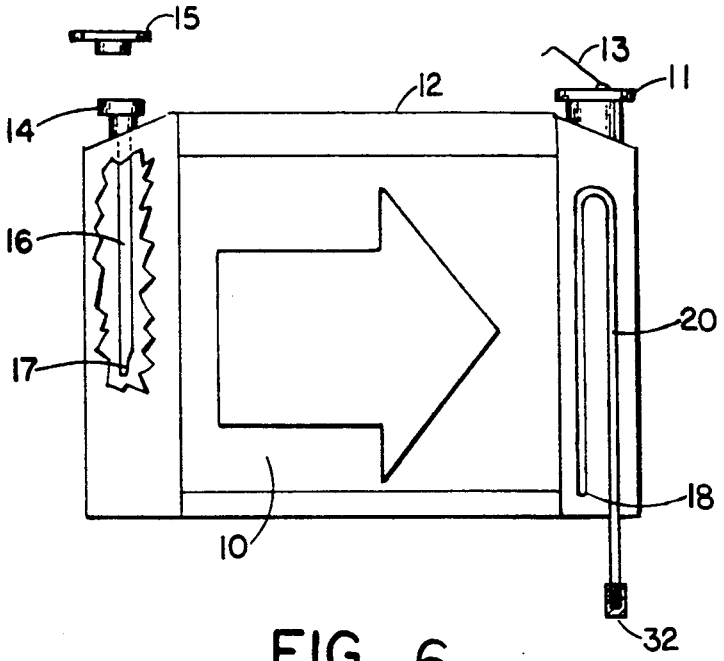
FIG. 6 illustrates yet another embodiment of the present invention wherein the valve means of the drain pipe is located on the outlet end of the drain pipe.

FIG. 6 illustrates a radiator wherein the valve is cap 32 at the end of drain pipe 20. Cap 32 connects to drain pipe 20 by conventional means such as threaded screw. Drain pipe 20 can be made from a flexible pipe for easy handling.

Figure 7:
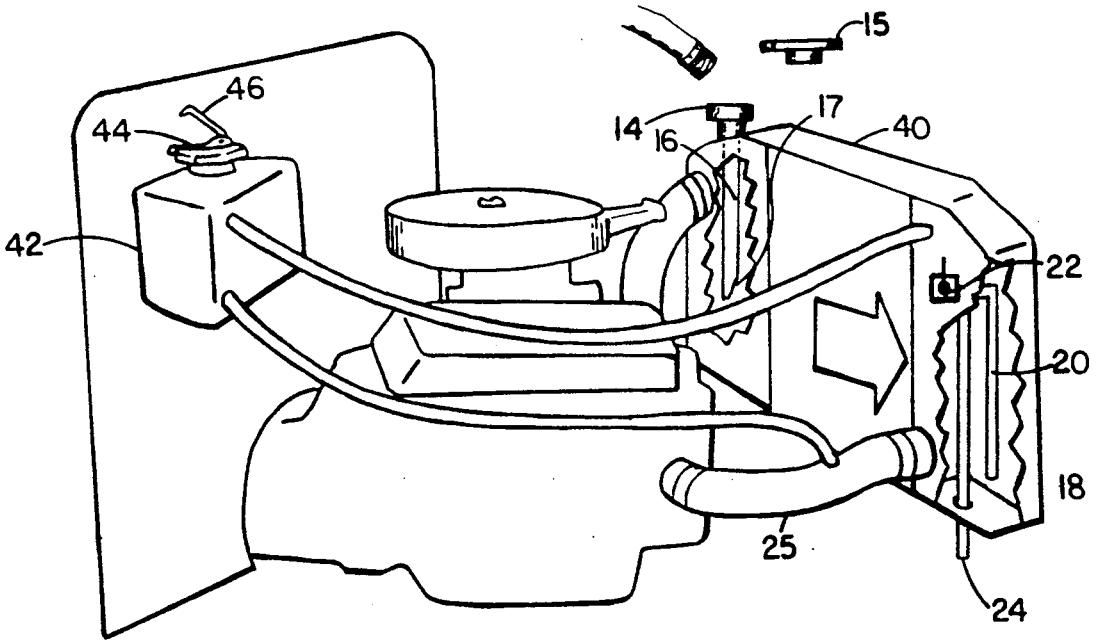
FIG. 7 illustrates a closed radiator system wherein the drain pipe is patterned on the inside of the radiator shell.

FIG. 7 illustrates the present invention in a closed radiator system. Radiator 40 is equipped with overflow tank 42 with cap 44. Cap 44 is equipped with vent lever 46. Radiator 40 is equipped with drain pipe 20 and flushing fluid inlet 14. Drain pipe 20 is fully enclosed in radiator 40.

Figure 8:
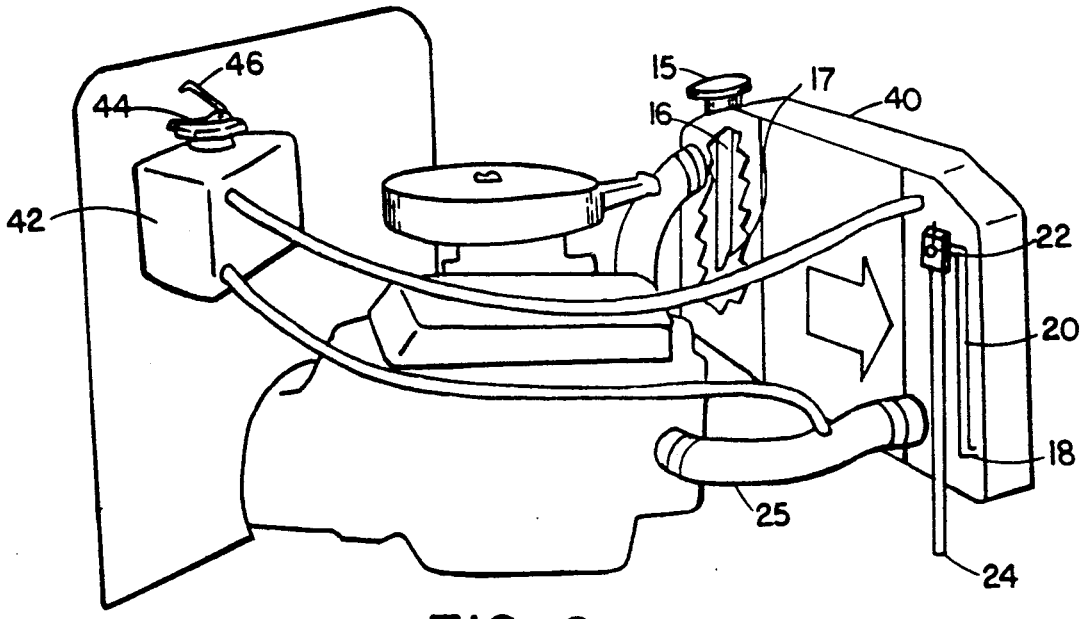
FIG. 8 illustrates a closed radiator system employing the present invention wherein the drain pipe is positioned on the outside of the radiator shell.

FIG. 8 illustrates the present invention in a closed radiator system similar to the one shown in FIG. 7 except for the fact that the drain pipe 20 and valve 22 are positioned on the outside of radiator 40.

Figure 9:
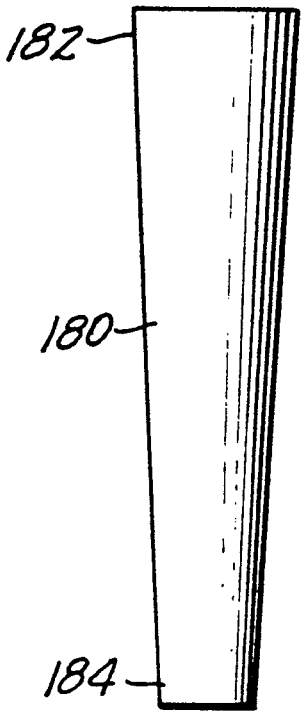
FIGS. 9–11 illustrate a restriction at the one end of the flushing fluid inlet pipe.

FIG. 9 illustrates a preferred embodiment of the restricted end of the flushing fluid inlet pipe for use in the present invention. As shown in FIG. 9, flushing fluid inlet pipe 180 is attached at end 182 to the flushing fluid inlet and tapers down to restricted end 184. Preferably, the amount of tapering is such that the inside diameter at end 182 is two or more times larger than the inside diameter at end 184.

Figure 10:
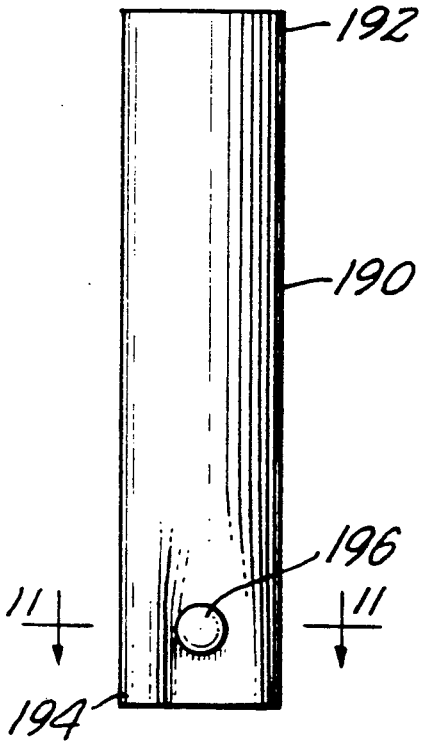

An alternative to the tapered design in FIG. 9 is to use a rivet or other means to restrict the end of the flushing fluid inlet pipe as shown in FIG. 10. Flushing fluid inlet pipe 190 attaches to the flushing fluid inlet at end 192 while end 194 with rivet 196 therein extends down into the radiator.

Figure 11:
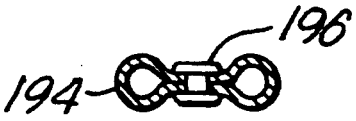

FIG. 11 shows a cross section of end 194 taken along line 11.

The embodiments in FIGS. 9 and 10 are preferred for use in a cross-flow radiator. It has been found that the restricted ends help to increase the pressure of the water exiting the tube and stir up the coolant and promote the efficiency of the flushing.

Figure 12:
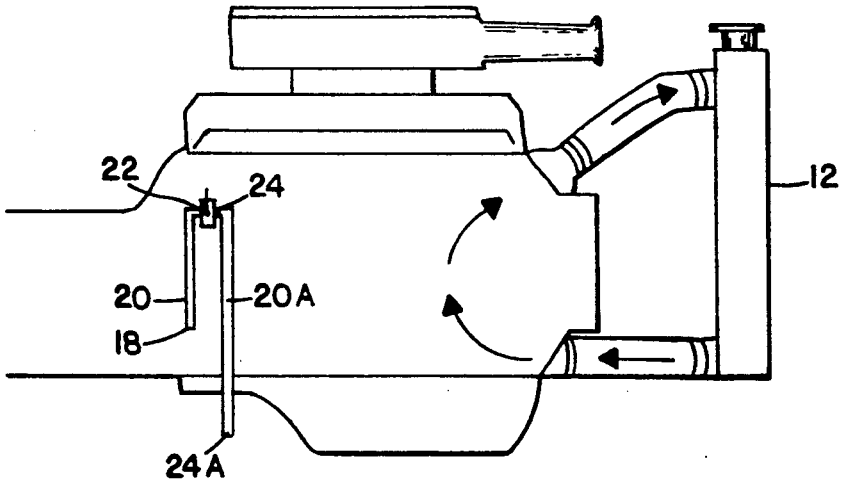
FIG. 12 illustrates the present invention employed in the engine block area rather than in the radiator itself.

FIG. 12 illustrates the present invention positioned back in the engine block area. In this embodiment outlet 24 is positioned adjacent to valve 22 and pipe 20A is connected to outlet 24 to provide outlet 24A. Flushing fluid inlet pipe 16 with restricted end 17 can also be used in a down-flow radiator as well as a cross-flow radiator. This embodiment both drains and flushes the engine block and the radiator.

In order to drain the fluid from the radiator, air must be let into the cooling system. Preferably, this is done by means of opening the radiator cap, the vent lever on the radiator cap, the overflow tank cap on a closed radiator system, or the vent lever on the cap of the overflow tank in the closed radiator system.

The outlet of the drain pipe can be threaded to accept a hose. Also, a pump can be connected to the drain pipe and aid in draining the radiator.

If flushing of the cooling system rather than draining and flushing of the radiator is important, then the drain pipe can be connected to a portion of the cooling system away from the radiator as shown in FIG. 12.

In order to flush the radiator without the engine running, the following procedure is preferably employed. First, connect the water hose to the flushing fluid inlet on top of the radiator. Then, open the valve or drain pipe. Then turn on the water supply to the flushing fluid inlet. The radiator will now flush.

In order to flush the radiator, motor block and heater core when starting with a cold motor, the preferred method is to first open the valve or drain pipe. Next, open the radiator cap or vent lever to allow air into the system and let the radiator drain. Then close the valve on the drain pipe, remove the cap on the flushing fluid inlet and connect a water supply to the flushing fluid inlet and fill the radiator, turn off the water supply and close the radiator cap or vent lever to seal the cooling system. Finally, start the motor and allow it to heat to normal temperature, thereby opening all the internal valves in the cooling system. Open the drain valve and turn on the water supply. Keep the motor running to circulate the old coolant and keep the thermostat open for circulation. Now you are flushing the motor block, radiator and heater core. The flushing is continued until water is clear.

It will be understood that the claims are intended to cover all changes and modifications of the preferred embodiments of the invention herein chosen for the purpose of illustration which do not constitute a departure from the spirit and scope of the invention.

What is claimed is:

1. In a radiator having a core and a shell and cooling fluid in said radiator, the improvement comprising:

a drain pipe having an inlet in communication with the cooling fluid and located at the bottom of the radiator shell, an outlet which is positioned lower than the inlet of the drain pipe and said drain pipe having a bend of about 180° therein, said bend positioned below the fluid level in said radiator;

a flushing fluid inlet connected to the shell for introduction of flushing fluid into the shell; and a valve means connected to said drain pipe such that when said valve means is opened fluid flows out of said radiator shell through said drain pipe.

2. The radiator of claim 1 wherein the valve means is located in the bend in said drain pipe.

3. The radiator of claim 1 wherein the bend in said drain pipe is located about 1 to about 2 inches below the fluid level in the radiator.

4. The radiator of claim 1 wherein the inlet for the drain pipe is located about ½ to about 2 inches above the bottom of the radiator shell.

5. The radiator of claim 1 wherein a flushing fluid tube is connected at one end to the flushing fluid inlet, said flushing fluid tube being restricted at the other end.

6. The radiator of claim 1 wherein the radiator is a down-flow radiator.

7. The radiator of claim 1 wherein the radiator is a cross-flow radiator.

8. The radiator of claim 1 wherein the radiator is part of a closed radiator system.

* * * * *